US006691434B1

(12) United States Patent
Couturier

(10) Patent No.: US 6,691,434 B1
(45) Date of Patent: Feb. 17, 2004

(54) SPORTS SHOE, ESPECIALLY FOR DOWNHILL SKIING SKI-TOURING, CROSS-COUNTRY SKIING, SNOW-BOARDING, ROLLER-SKATING OR ICE-SKATING

(76) Inventor: Jean-François Couturier, 1987, Heremence (CH)

( * ) Notice: Subject to any disclaimer, the term of this patent is extended or adjusted under 35 U.S.C. 154(b) by 0 days.

(21) Appl. No.: 09/979,189

(22) PCT Filed: May 17, 2000

(86) PCT No.: PCT/CH00/00271

§ 371 (c)(1),
(2), (4) Date: Nov. 16, 2001

(87) PCT Pub. No.: WO00/69297

PCT Pub. Date: Nov. 23, 2000

(30) Foreign Application Priority Data

May 17, 1999 (FR) ..... 99 06443

(51) Int. Cl.[7] ..... A43B 5/04; A43B 23/02; A43B 7/20

(52) U.S. Cl. ..... 36/117.1; 36/109; 36/89

(58) Field of Search ..... 36/117.1, 117.2, 36/88, 89, 92, 109

(56) References Cited

U.S. PATENT DOCUMENTS

| | | | | |
|---|---|---|---|---|
| 3,747,235 A | | 7/1973 | Post | |
| 3,822,491 A | | 7/1974 | Rathmell | |
| 4,420,895 A | * | 12/1983 | Baumann et al. | 36/117.1 |
| 5,090,138 A | * | 2/1992 | Borden | 36/89 |
| 5,815,953 A | | 10/1998 | Kaufman et al. | |
| 5,894,684 A | * | 4/1999 | Sand et al. | 36/117.1 |
| 5,937,546 A | * | 8/1999 | Messmer | 36/89 |
| 6,168,172 B1 | * | 1/2001 | Meibock et al. | 36/89 |
| 6,209,229 B1 | * | 4/2001 | Bourdeau | 36/117.1 |
| 6,406,040 B1 | * | 6/2002 | Thorne | 36/117.1 |

FOREIGN PATENT DOCUMENTS

| | | |
|---|---|---|
| DE | 2718939 | 4/1977 |
| FR | 2 544 969 | 11/1984 |
| FR | 2745988 | 9/1997 |
| FR | 2758093 | 7/1998 |

* cited by examiner

*Primary Examiner*—Anthony D. Stashick
(74) *Attorney, Agent, or Firm*—Davis & Bujold, PLLC

(57) ABSTRACT

The invention relates to a sports shoe, especially for downhill skiing, ski-touring, cross-country skiing, snowboarding, roller-skating or ice-skating. The inventive shoe essentially comprises a rigid underframe (11), which is located below the ankle of the wearer, two connecting links (30, 31) between the underframe and the leg of the wearer, and two casings (14, 15), which are arranged in such a way that they can firmly link the leg of the wearer to the connecting links. The underframe (11) comprises a front housing (18) and a rear housing (19). The housings are arranged in such a way that they can receive a soft inner boot (12). The underframe (11) also comprises shoulders (17, 17'), which enable the shoe (10) to be fixed in a conventional binding. The inner boot (12) is able to move inside the underframe. These movements can be a vertical movement of the heel and/or be made about a longitudinal axis in relation to the foot of the wearer, in such a way that the leg of the wearer can move naturally during the sporting acitivity.

21 Claims, 17 Drawing Sheets

SPORTS SHOE, ESPECIALLY FOR DOWNHILL SKIING SKI-TOURING, CROSS-COUNTRY SKIING, SNOW-BOARDING, ROLLER-SKATING OR ICE-SKATING

FIELD OF THE INVENTION

The present invention concerns a sports shoe or boot, notably for alpine skiing, ski touring, cross-country skiing, snowboarding, roller skating or ice skating, comprising a rigid frame arranged under the wearer's ankle and defining at least a housing in which is placed an inner boot receiving the wearer's foot and combining with this frame at least one link extension between the frame and one leg of the wearer, and at least one casing fitted to join the wearer's leg firmly to the link extension.

BACKGROUND OF THE INVENTION

The majority of sports shoes or boots such as shoes for in-line skates or skiing notably, comprise a rigid or hard shell stretching well above the ankle and gripping the latter so as to practically totally block its movements during sporting activities.

This type of shoe presents a certain number of disadvantages. Particularly due to their rigidity, the use of such shoes often causes injury such as notably:

diverse damage to knee and ankle ligaments;

painful tibia supports, posterior leg muscle affected;

bursitis on the foot, (Haglund's disease);

inflammation of the Achilles tendon;

painful condition of internal and external ankle bones;

shin splints;

displacement and damage to the semilunar cartilage;

compression of the metatarsus (Morton's syndrome);

stiffness of the lower member due to its compression;

atrophy of the foot muscles of the ankle and calf at the end of the season; and cold feet, partial frostbite and associated circulatory complications.

Other sports shoes have been made with a hard shell which stops below the ankle and which is supposed to leave the ankle free. These shoes have the characteristic of blocking the foot in the shell by means of straps arranged on the instep.

The techniques employed in shoe and boot design have evolved to provide greater comfort, but this maintaining and locking action of the bottom of the leg still causes considerable injury and discomfort for wearers, often exposed to twisting of the bottom of the leg notably when falling. With hard shoes, the maximum resistance time of the twisting leg is considerably decreased by the rigidity of the shoes, which prevents complete movement of all the particular and muscular chain of the leg muscle segment. Violent twisting at the time of falling backwards is accentuated by the lack of posterior particular and muscular mobility of the leg, the effect of which is to transfer the twisting force abruptly onto the knees. The leg is blocked by the rigid neck of the shoe or boot. This type of fall widely described notably in the works of Professor Johnson in the United States shows up the dangers of ski boots that are too rigid, when falling and twisting backwards. On the other hand, it appears that blocking the feet and ankle articulations is responsible for the forced inactivity of leg muscles. These muscles are no longer correctly used to react in the case of a fall or unexpected change in direction and therefore do not correctly protect the knee and the ligaments. What is more, sensitivity of the foot is alleviated by this very same blocking of the foot and lower leg to which an external overall compression is added to obtain resistance and precision. The effect of this is to limit sensory activities. In the special case of skiing, this in part explains the difficulties of posture for many skiers.

Certain developments have been made to attempt to solve the problem of hard shell shoes or boots. One of these developments is illustrated in the U.S. Pat. No. 3,747,235. This document describes a ski boot comprising a rigid inner boot fixed to the ski and enveloping the foot, a lever fixed to the inner boot and extending practically up to the knee, a stirrup fixed to the lever and designed to prevent a sideways movement of the leg relative to the lever, and a strap which prevents longitudinal movement of the leg in relation to the lever. The rigid inner boot stops under the ankle and does not appear to block its movement. In actual fact, when the boot is held in a ski binding, the foot is blocked in the boot and the ankle articulation is blocked. The link between the leg and ankle is made by the lever that transmits the effort to the skis so as to allow the skier to direct the skis.

The aim of this boot is to avoid a certain number of problems associated with hard shell boots, in particular those due to compression of the foot in the shoe (bursitis, painful ankle bones, etc.). Unfortunately, this system does not allow using the muscular and particular locking of the whole leg. So, a certain number of problems persist and others appear.

The link between the leg and the ski is made just below the knee. This implies a risk of displacing and drawing of the knee. This "drawing" is very frequent with those suffering from laxity or damage in knee ligaments. This can also cause inflammation of knee ligaments as well as compression of the glands and Thorel's bundle. This link creates a compression and crushing of the posterior tibial artery, restricting irrigation of the lower leg. This strap is also directly against the fibula. It blocks the displacement of the latter which, during each leg movement, is normally displaced both in rotation and in translation.

The fact of blocking movements of the fibula causes pain and eliminates the natural particular and muscular blocking of the leg. Another problem associated with using a strap is the transmission of movement from the leg to the ski. If the strap is not very taut, this transmission is not perfect and the skis are difficult to direct. For transmission to be made in a reliable manner, it is essential that the leg cannot move at all in the strap. This implies that the strap must be very tight. It can result in pain of the same sort that appears with the use of hard shoes or boots.

Lastly, a major problem with this boot and its binding stems from the fact that the inner boot is firmly fixed in the binding. Although the ankle is not blocked by the boot itself, the rigid holding of the boot in the binding prevents natural movements of the foot, as is explained in detail below.

There are other documents describing sports shoes or boots designed to leave articulation of the ankle free. Among documents, the French patent applications published under No. FR-A-2 758 093 and FR-A-2 745 988 can be mentioned as well as the German publication No. DE 27 18 939.

The French patent application No. FR-A-2 758 093 describes an in-line roller skate formed by a conventional boot, a sole interdependent of the roller skates, a platform on which the boot rests, and a rigid extension linking the sole to the leg of the wearer. The rigid extension holds the leg through the use of a ring. This extension is mobile and can move forwards and backwards, but not sideways.

Given that the natural movement of the ankle implies also a sideways rotation during its forwards or backwards rotation, as the rotation axis of the ankle is not horizontal and perpendicular to the symmetrical line of the human body, the fact of stopping lateral rotation blocks rotation of the ankle at least partially. A chain displacement of leg articulations as a whole is therefore impossible, for one of the movements is blocked.

The German publication No. DE 27 18 939 describes a ski boot which can be used with a conventional inner boot. This boot comprises a shell in which the inner boot is immobilized by using air pads. The aim of this invention is to firmly maintain the foot in the shell, whilst avoiding restrictive zones. The fact of maintaining the foot stops natural movement of the leg.

Lastly, the French application No. FR-A-2 745 988 describes a sports shoe or boot comprising a rigid sole, a low drag-link which ends under the ankle and a guiding element which permits rotation of the tibia forwards, while at the same time preventing a sideways movement.

As is described in detail hereafter, all movement of the leg implies a coordinated movement of the ankle, knee and hip. The fact of preventing the movement of one of these articulations, even in one direction, destroys coordination of movement and prevents the leg from making a physiological displacement.

The sports shoes or boots of the prior art all have the same aim of maintaining the foot tightly, either in a hard shell, by straps on the instep or by inflatable pads, and a typical feature of preventing movement of the ankle in at least one direction.

Due to this, none of the inventions described in documents of the prior art allow a physiological movement of the leg in the sport involved, even in the case where articulation of the ankle appears to be free.

SUMMARY OF THE INVENTION

The present invention is offering to resolve the disadvantages of shoes or boots of the prior art by proposing a shoe or boot which allows the physiological movements of the leg as a whole, and of the ankle and knee in particular, notably by allowing movement of the sole of the foot as compared with the support made up by the ski or roller skate.

As mentioned previously, rotation of the leg as a whole can be divided into rotation of the knee, rotation of the ankle and rotation of the hip.

Rotation of the knee is controlled by two groups of muscles. The first group is made up of external rotator muscles which, when activated, have the effect of turning the tibial plate so as to direct the toes outwards. The second group includes internal rotator muscles which tend to direct the toes inwards. Overall, the group of internal rotators is slightly stronger than the group of external rotators. Bending the knee causes rotation of the tibia inwards as well as displacement of the fibula in rotation and translatory movement around its center line.

Rotation of the ankle can be made around three axes. One axis practically horizontal and transversal (X) which passes roughly by the ankle bones, a vertical axis (Y) situated in the extension of the leg and a longitudinal horizontal axis (Z).

The rotational movement of the ankle around the transversal horizontal axis (X) is called "extension" when the toes are lowered, and "flexion" in the opposite case. The rotational movement around the vertical axis (Y) is called "adduction" when the toes are drawn inwards, towards the plane of symmetry of the body, and "abduction" when the toes are pushed outwards from this plane of symmetry. Lastly, movement around the longitudinal horizontal axis (Z) is called "supination" when the sole of the foot turns inwards and "pronation" when it turns outwards.

During natural ankle rotation, movements around the three axes are always linked. Adduction is unavoidably accompanied by a supination and an extension.

The position reached is called inversion position. If the extension is compensated by an equivalent flexion, one obtains in varus stance.

In the other direction, abduction is accompanied unavoidably by pronation and flexion. The position reached is called "eversion". If the flexion is cancelled by an equivalent extension of the ankle, one obtains ex valgus stance.

The "eversion" position is obtained mainly by the action of two muscles—the short lateral peroneal and the long lateral peroneal. These are attached to the front half of the sole of the foot, respectively on the outside edge and inside edge of the foot.

All the shoes or boots of the prior art maintain the foot tightly against the support. Furthermore, they prevent rotation of the ankle around the longitudinal horizontal axis (Z). Blocking of this movement breaks the particular chain formed by the ankle, knee and hip. This also has the effect of preventing the natural muscular blocking obtained by the physiological use of the muscles.

The aim of the present invention is to resolve the disadvantages of sports shoes or boots of the prior art and to allow a natural movement of the whole leg by allowing chain synergy of the leg articulations as described above. Another aim of the invention is to increase the sensitivity of the wearer. This aim is achieved by the fact that the lower member is free, therefore sensitive.

These aims are achieved by a sports shoe or boot such as is defined in the preamble and characterized in that the shoe or boot comprises means to allow a movement of the inner boot around a longitudinal center line of the foot in relation to the frame during use of the shoe or boot by the user and in that the link extension is resilient in flexion and in rotation.

According to a first embodiment, the means for allowing a movement of the inner boot around a center line can comprise at the least one longitudinal protuberance arranged between the inner boot and the frame, under the inner boot. The longitudinal protuberance can be interdependent of the liner or the frame.

According to a realization variant, the means to allow movement of the inner boot around a longitudinal axis comprises two longitudinal protuberances formed by a platform linked to the inner boot through a semi-rigid flat reinforcing rib in line with the said longitudinal axis.

This longitudinal protuberance disposed between the inner boot and the frame defines gaps on either side of this protuberance, these spaces being conveniently filled with soft stuffing matter.

The frame advantageously comprises means to allow a vertical movement of the back of the inner boot as compared to the frame. These means can comprise a shoulder arranged on the inner boot and a buffer stop shaped in the frame.

According to a preferred embodiment, the boot according to the invention comprises a back casing designed to be adapted to the morphology of the wearer's calf, and a front casing designed to be adapted to the morphology of the wearer's tibial plate, with at least one of the casings being linked to the link extension.

The front casing can comprise a support element for the knee, designed to be in contact with the wearer's knee.

The casing fixed to the link extension is mobile in rotation over a given angular range around the said link extension and comprises adjustment means for volume between the back and front casing, and adjustment means for the height of the front casing and/or back casing.

According to a particular form of realization, one of the link extensions has an end element placed near to the extremity of the peroneal muscles.

One of the link extensions can also comprise an end element positioned near to the heel.

According to a particular embodiment, the boot comprises two link extensions.

In the first embodiment of the invention, one of the link extensions is arranged towards the back of the inner boot.

In a second embodiment of the invention, the two link extensions are arranged on the sides of the inner boot.

In a particular form of realization, the link extension is arranged between the inner boot and the frame.

The link extension can also be made up of at least two superimposed strips.

According to an advantageous variant, the inner boot is detachable from the frame.

According to a particular embodiment in which the shoe is used as a ski boot, the inner boots are preferably placed in the frames in such a way that when the skis are parallel, the edge of one inner boot, arranged towards the plane of symmetry of the wearer's body, forms an angle opening forwards with the corresponding edge of the other inner boot.

BRIEF DESCRIPTION OF THE DRAWINGS

The present invention and its advantages will be better understood with reference to different embodiments and drawings in which.

DETAILED DESCRIPTION OF THE INVENTION

With reference to FIGS. 1 to 18, the sports shoe or boot according to the present invention is illustrated in the embodiment for an alpine ski boot, although it could well be used for other sports such as notably ski touring, cross-country skiing, or snowboarding. FIG. 19 illustrates a shoe or boot for roller skate, but the shoe can also be adapted to ice skates.

Figure 1:
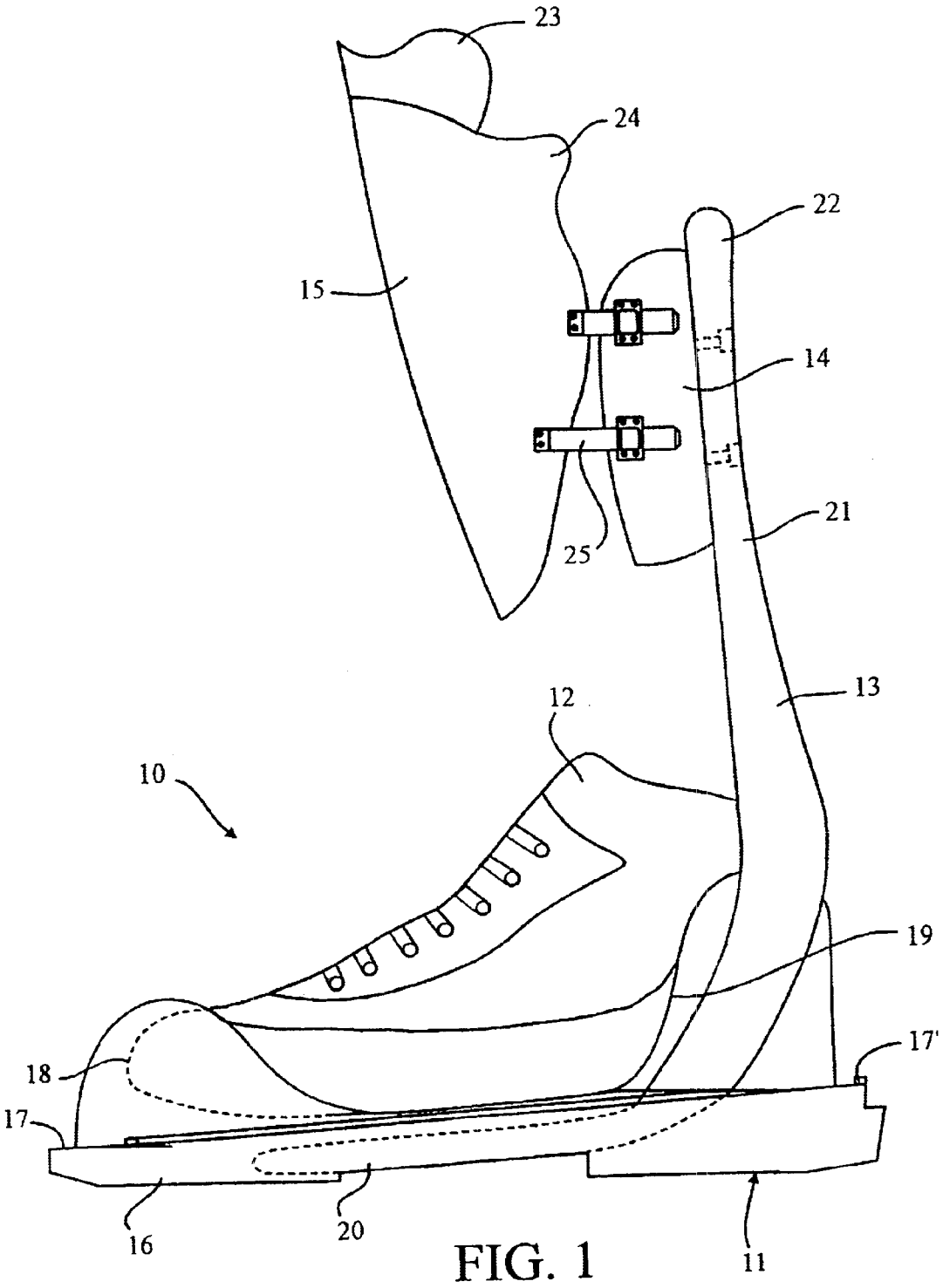
FIGS. 1 and 2 illustrate two different forms of realization of shoes according to the invention as boots, applied in the case of skiing.

FIG. 1 illustrates a shoe 10, mainly comprising a frame 11, a inner boot 12, a link extension 13, and two holding casings 14,15, worn as a boot.

The frame 11 is a hard rigid part comprising a base 16 fitted with two shoulders 17, 17' arranged so as to facilitate holding the frame in a conventional ski binding (not shown). It also comprises a front housing 18 designed to hold the inner boot firmly in the frame. Lastly, it comprises a rear housing 19 designed to hold the back of the inner boot 12 in the frame.

Holding the inner boot in the frame includes a certain amount of play which allows the inner boot to shift slightly in the frame. This is explained in more detail with reference to FIGS. 8 to 13. The frame is arranged under the ankle so that in no case are the ankle movements impeded by the frame.

The inner boot 12 is a supple inner boot such as a basket-ball or tennis shoe, which does not block articulation of the ankle. This inner boot can be chosen in such a way as to provide specific comfort. The inner boot can act as an ankle boot and stop above the ankle but in this case it must be sufficiently supple not to hinder movements of the ankle.

The boot also comprises a rear link extension. This has a more or less horizontal part 20 inserted in the frame 11, and a more or less vertical part 21, stretching roughly parallel to the lower part of the skier's leg.

The horizontal part 20 of the link extension 13 stops just under the front extremity of the two lateral peroneals. This considerably improves feeling of the skier, due to the fact that the sensitive areas of the foot are near to one of the elements which enable directing the skis. Other realization methods could however be envisaged.

The rear link extension 13 is associated to the rear casing 14 which takes the exact shape of the skier's calf. This casing is held by the link extension and its precise positioning can be adjusted in a conventional manner. This casing can be filled with structural foam or a filling foam to allow individuals to adjust these casings to the shape and volume of their legs. This casing functions with the link extension 13 notably in rotation, when this extension bends. This allows the casing to remain immobile in relation to the leg and avoids friction on the leg.

Figure 3:
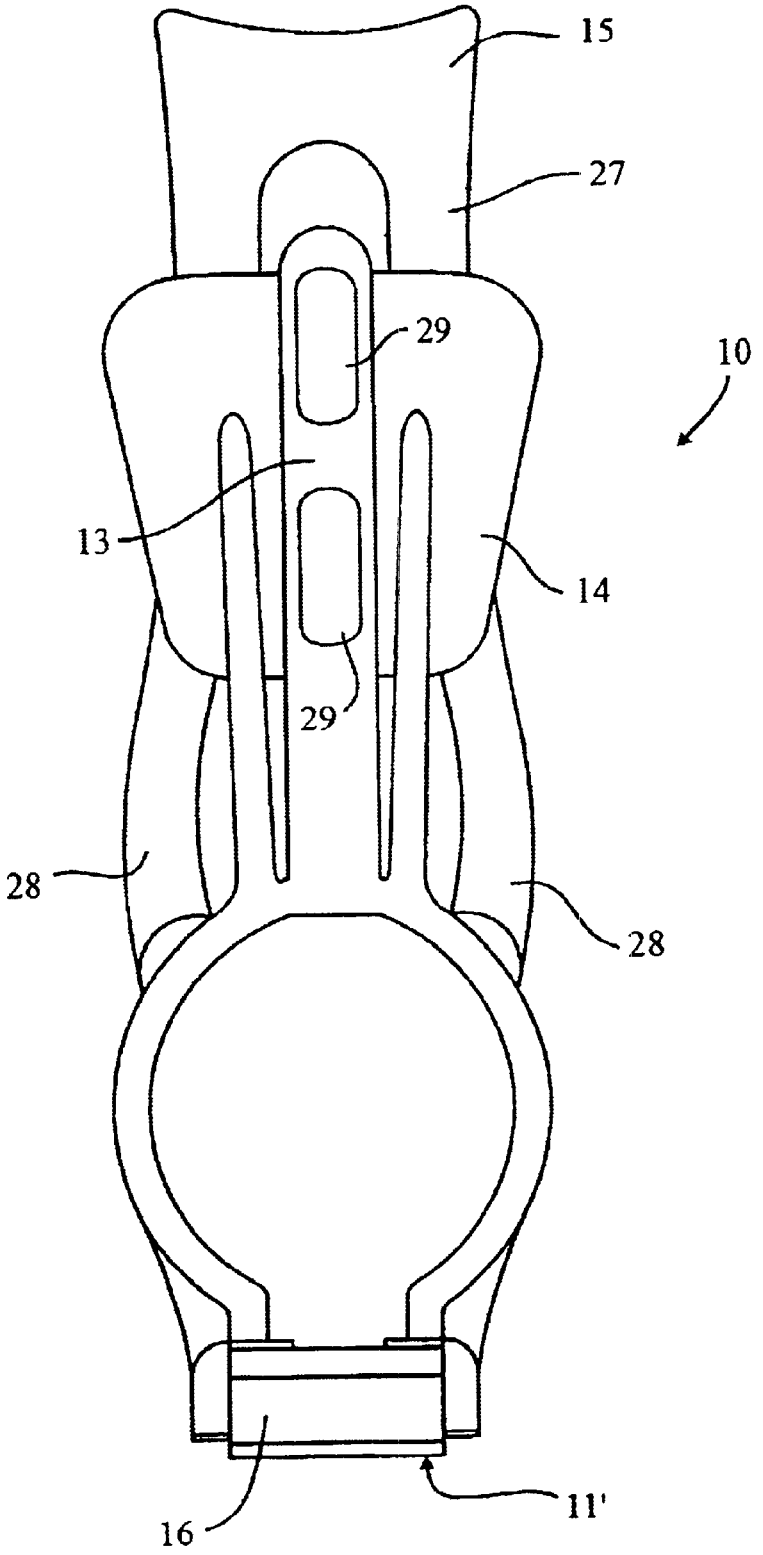
FIG. 3 is a view of the back of the boot in FIG. 2.

The rear link extension 13 can consist of a single drag-link 22, a double or even triple drag-link, as illustrated for example in FIG. 3. The material making up the link extension 13 is chosen for a certain predefined elasticity, when bending and rotating. This material can, for example, be metal, a synthetic material, or a composite material such as carbon or carbon polyamide, and possibly include additions of fibres or particles allowing the adjustment of modules of elasticity when bending and rotating. The shape of the extensions is also chosen in such a way as to allow bending forwards, while at the same time limiting bending backwards, without totally preventing this bending.

As this has already been discussed, rotation of the knee causes a rotation of the lower leg. The rotational elasticity of the link extension 13 on the one hand permits this rotation and on the other transmits the efforts generated by the skier onto the ski so as to direct the skis.

The bending elasticity of the link extension 13 limits displacement of the extension towards the back of the ski. When bending the leg forwards, the elasticity of the extension implies that a force is exerted on the front of the ski. This allows excellent control in directing the ski.

After a turn, when the skier straightens up, the elastic link extension frees the stored energy and makes it easier to take up the initial position again. Elasticity of the bending extension also allows eliminating the needless overpressures of the ski on the ground when crossing moguls. With the hard rigid boots of the prior art, when the skier hits a mogul, the energy partly absorbed by the deformation of the ski is then transmitted to the skier through the boot, which consequently creates harmful effects which can abruptly slow down the skier in his elan.

For a beginner or average skier, clearing a bump in practice is made difficult for while the skis are crossing a mogul the energy is transmitted from the skis in deformation to the boot which is rigid and which sends back the effort and strain to the leg of the skier. The clearing of obstacles causes a loss of balance for the skier which can lead to loss of control of the skis and eventually a fall.

For the experienced skier, the clearing of an obstacle is often compensated by a resistance or compensatory pushing on the tongue of the boot which has the effect of creating useless overpressures under the ski, thus the direct overall effect is the braking of elan. In a competition run, these slowing-downs through overpressure can cause a combination detrimental to the skier's final performance.

With the boot according to the present invention, the simultaneous deformation of the ski and the boot are proportional, hence the advantage for the beginner or average skier who does not suffer the jerks from the moguls and bumps.

The competition skier will find his performance enhanced thanks to the absence of overpressures under the skis thus facilitating slide with a better distribution of the ski and boot deformations simultaneously on the different types of bumps.

The boot 10 also comprises a front casing 15 adapted to the morphology of the user's leg. This casing is attached to a support element 23 for the knee which partially surrounds the lower part of the knee. The support element 23 can pivot in relation to the front casing 15, so as to support the knee without causing inconvenience. The front casing partially surrounds the leg and comprises two lateral zones 24 which protect the lower lateral part of the knee.

The back 14 and front 15 casings are linked together by means of a rigid or elastic strap 25 or a Velcro® strip, for example. This link can be very flexible. The casings surround the leg over a wide surface. The clever arrangement of supports, notably on the tibial bone and the upper and lateral part of the tibia as well as on the internal and external sides of the base of the knee gives accurate holding support. It is therefore not essential that the link is tight in order to be able to transmit to the ski the movements which direct them and one thus avoids any permanent compression of the leg tissues. Displacement of the leg bones and especially the fibula is not hampered.

Figure 2:
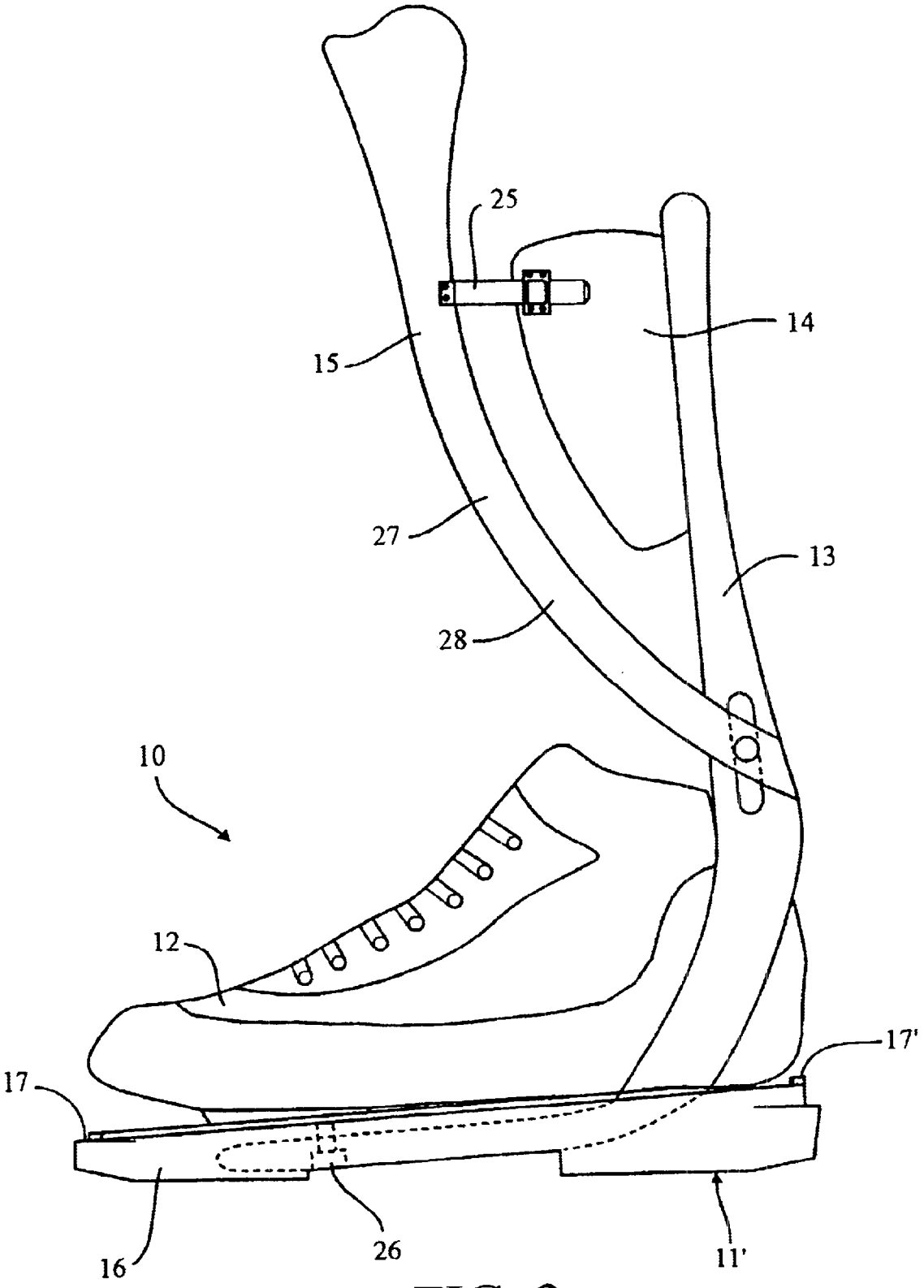

In the embodiment illustrated in FIGS. 2 and 3, the boot 10 mainly comprises the same elements as those illustrated in FIG. 1. These common elements bear the same reference numbers. The boot comprises a frame 11' without housings as in the previous case. The inner boot is held on the base 16 of the frame by a fixing screw 26 screwed under the sole of the inner boot. The boot comprises moreover a front link extension 27 joined to a front casing 15. More exactly, the front link extension 27 also plays the role of front casing 15. These two functions are in fact ensured by the same part.

The position of the front link extension 27 is also adjustable so as to provide the best fit for the shape and morphology of the user. This front link 27 comprises a lower zone which is separated into two tongues 28 arranged either side of the foot. These tongues are fixed, but able to pivot on the back link extension.

As previously, the back 14 and front 15 casing are linked together by means of a rigid or elastic strap 25 or a Velcro® strip for example. Adjustment of the back casing is made with oblong holes 29, as can be seen in FIG. 3.

Figure 4:
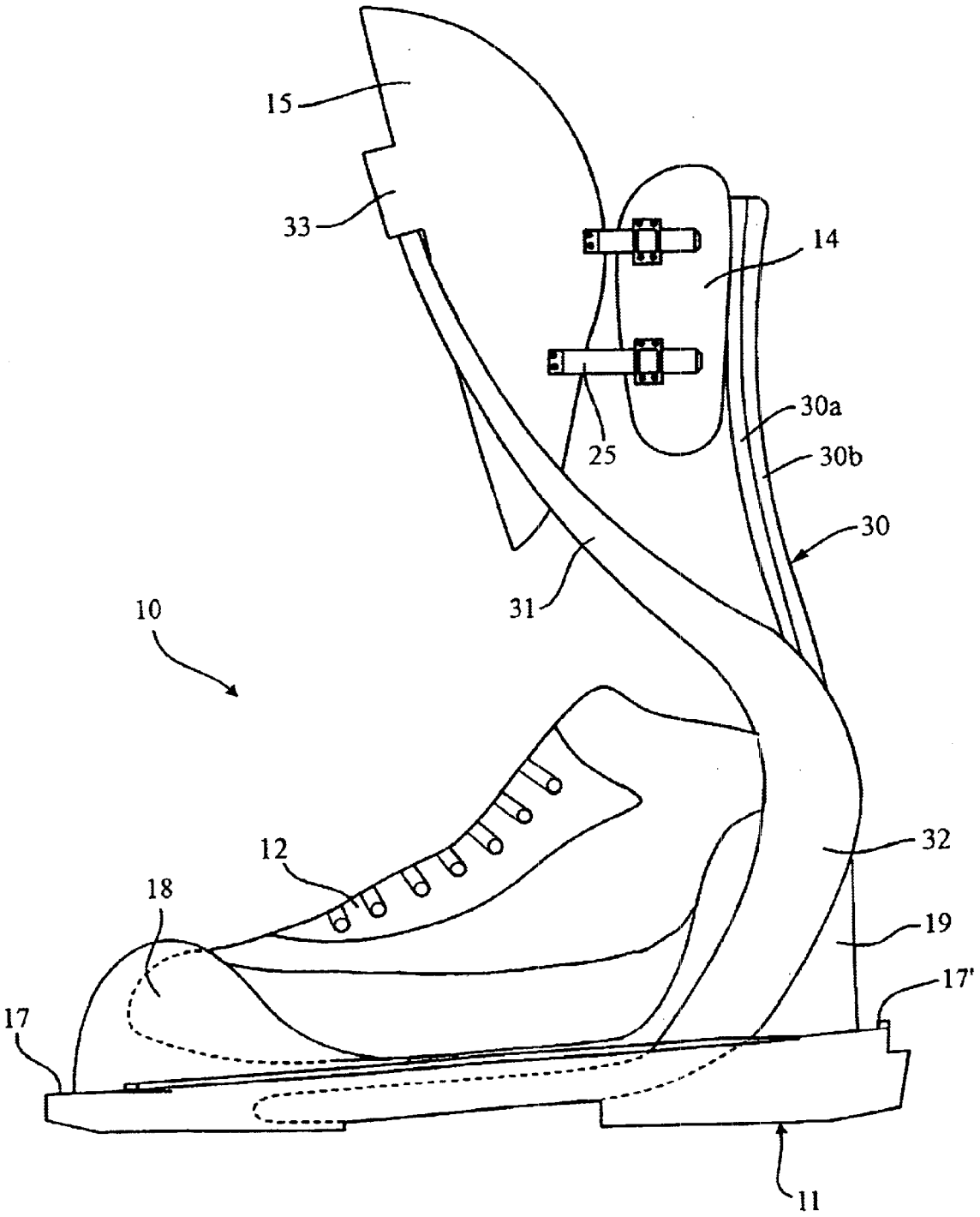
FIG. 4 is a variant of a sports shoe according to the invention.
Figure 5:
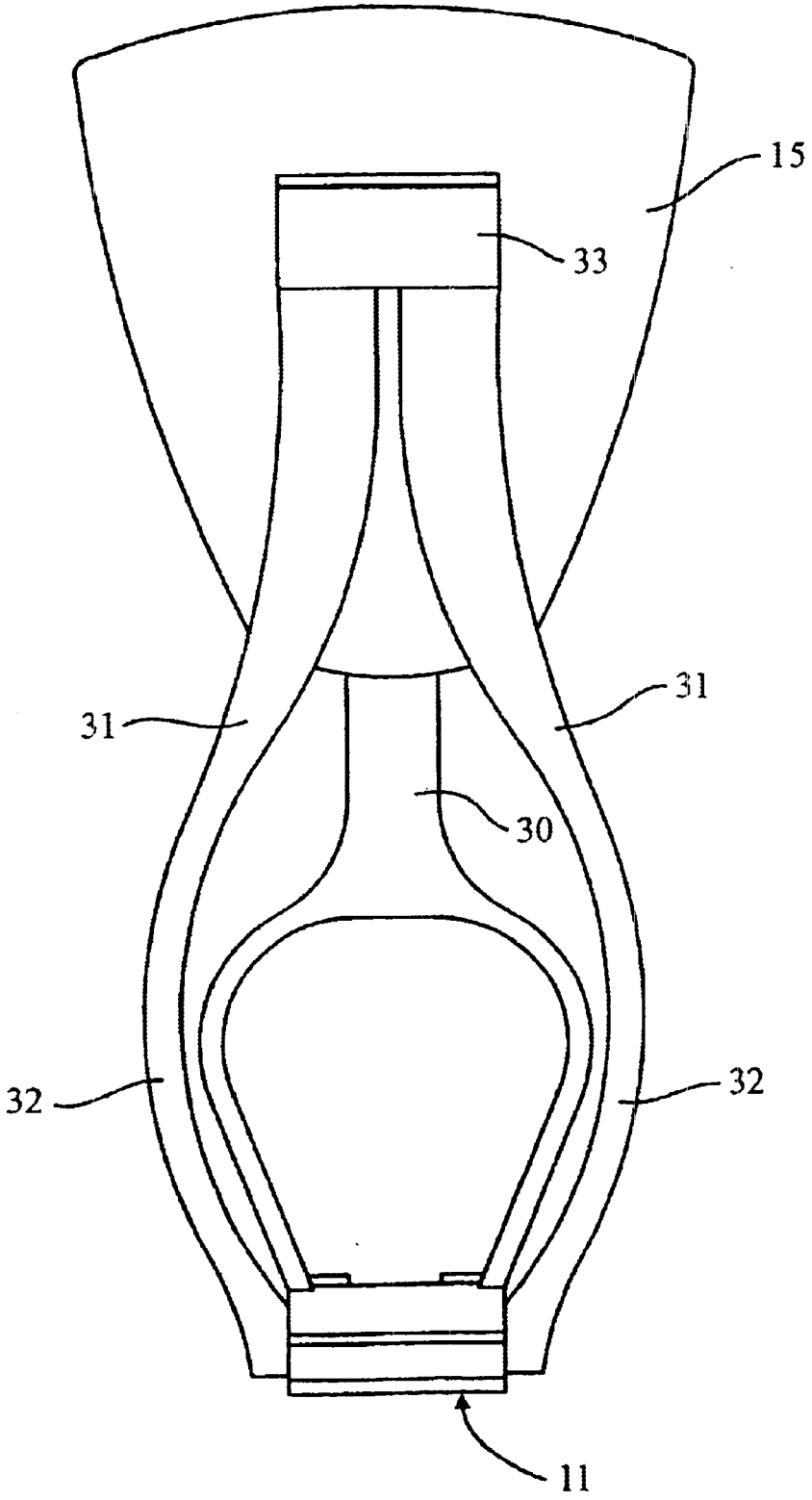
FIG. 5 is a view of the front of the shoe in FIG. 4.

In the embodiment illustrated in FIGS. 4 and 5, the boot 10 comprises a back link extension 30 and a font link extension 31. The back link extension 30 is directly linked to the frame 11 without being attached to the front link extension 31. The end of this back extension 30 stops under the heel. The front extension separates into two tongues 32 which each penetrate a side of the frame and which finish under the front of the lateral peroneals. In this realization, the three sensitive areas of the sole of the foot, i.e. the heel and the ends of the two peroneals, are near to the extremities of the link extension. This allows a particularly effective sensitivity. The back link extension 30 is made up of two strips 30*a*, 30*b*, which facilitates an especially healthy distribution of torsional and bending efforts.

The front link extension 31 comprises an adjustment zone 33 which facilitates positioning the front casing 15 accurately. Its position and its shape are chosen so that they are well suited to the morphology of the user. The front and back casings are attached by a strap 25.

Figure 6:
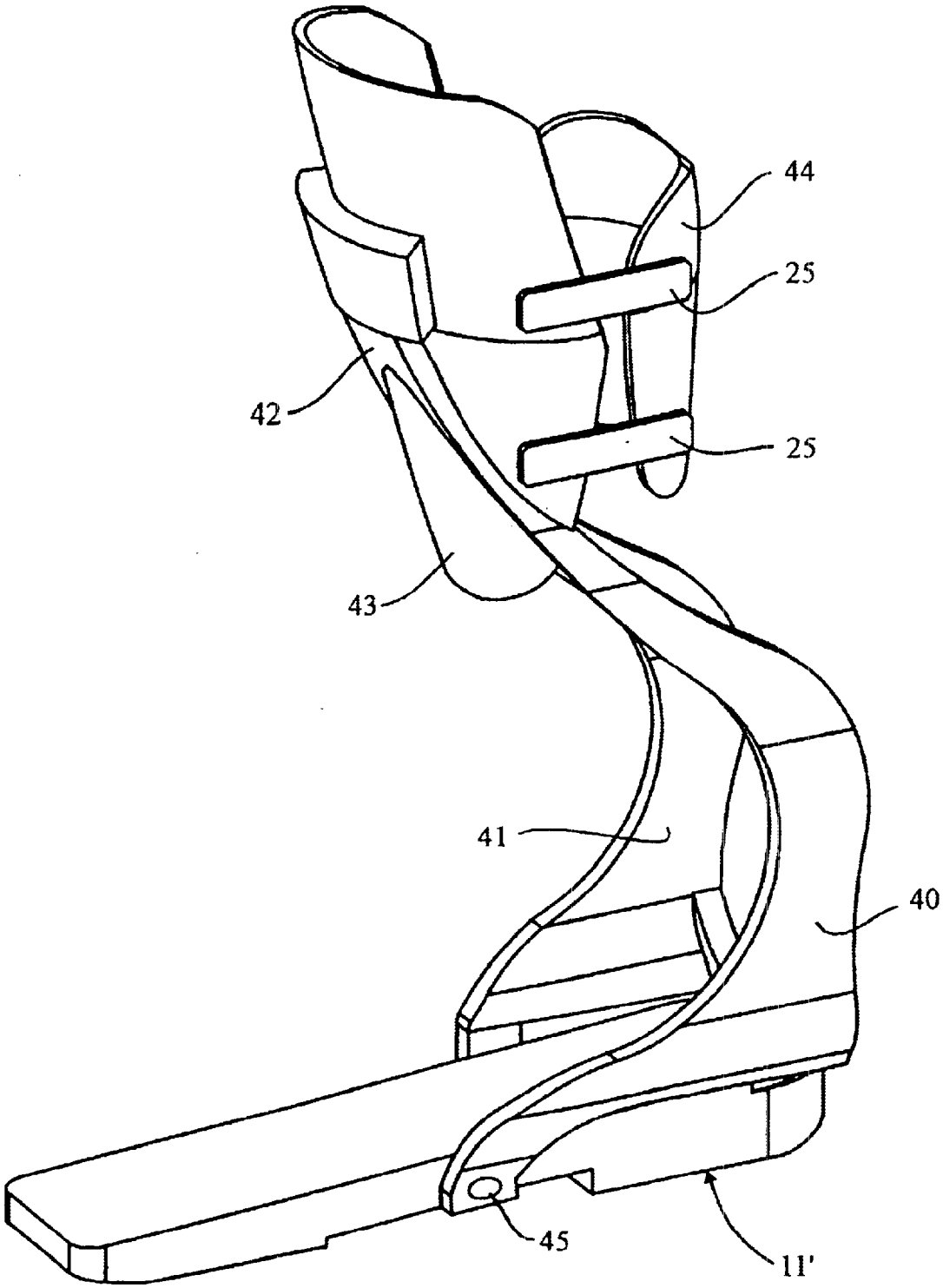
FIG. 6 is a view in perspective of a particular embodiment of the shoe or boot.
Figure 7:
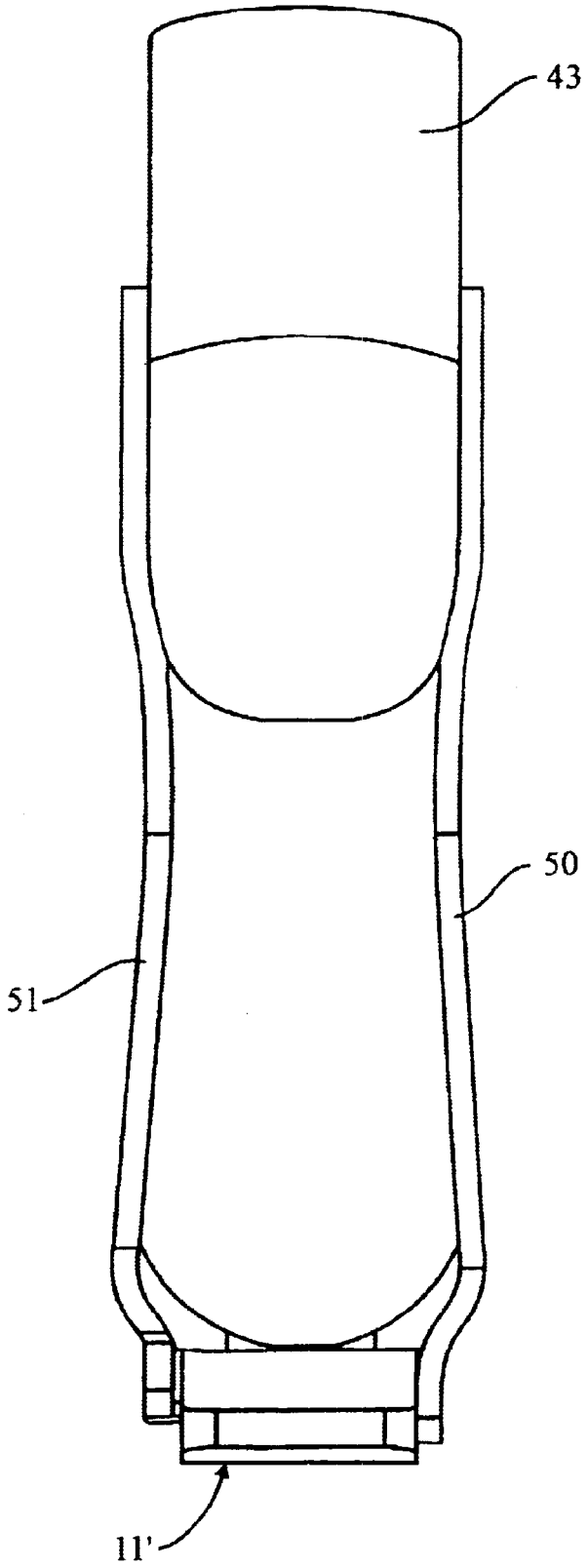
FIG. 7 is a front view of a shoe or boot variant according to the invention.

FIGS. 6 and 7 illustrate two variants in which the link extensions are lateral extensions, in other words they are attached to the frame 11' by the sides of the latter. Furthermore, these extensions stretch over the sides of the foot and bottom of the user's leg.

In the embodiment in FIG. 6, the two lateral extensions 40, 41 meet on the front of the tibia and are attached at this level. The linkage zone 42 of the two extensions support a front casing 43 similar to the front casings of previous realization methods. This front casing is attached by straps 25 to back casing 44. The link between the lateral extensions 40, 41 and the frame 11' is made by means of semi-permanent pins 45. This facilitates totally separating the unit comprising the link extensions and the casings from the frame. This realization enables offering a comfortable ski touring boot. The leg of the wearer is attached to the link extensions 40, 41 and to the casings. The inner boot is held only on the front of the frame, for example by means of a screw or any adequate fixing device. The back of the inner boot is not held at all which allows walking. When this boot is used for downhill skiing, the pins 45 are repositioned so as to provide a join with the inner boot and link extensions with the frame.

In the embodiment in FIG. 7, the two lateral link extensions 50, 51 do not meet and are arranged on the sides of the leg. Each of the extensions holds up one side of the front casing 43.

In the two realization methods described above, it should be noted that the link extensions are not symmetrical. These two extensions have slightly different functions and their shape is adapted to these functions. The internal lateral link extension 41, 51 is designed to facilitate taking the bearing when directing the ski. It also serves to transmit the bending and rotation of the user's leg to the ski in order to facilitate its control. When turning, it mainly works in compression. Due to this, it must be relatively rigid. The external lateral link extension 40, 50 is mainly designed to limit bending. It works principally in traction and can be fairly supple and flexible. The internal lateral extension could be compared to the tibia, whereas the external lateral extension could be compared to the fibula.

FIGS. 8 to 11 illustrate in detail the possible lateral movements of the inner boot in the frame.

Figure 8C:
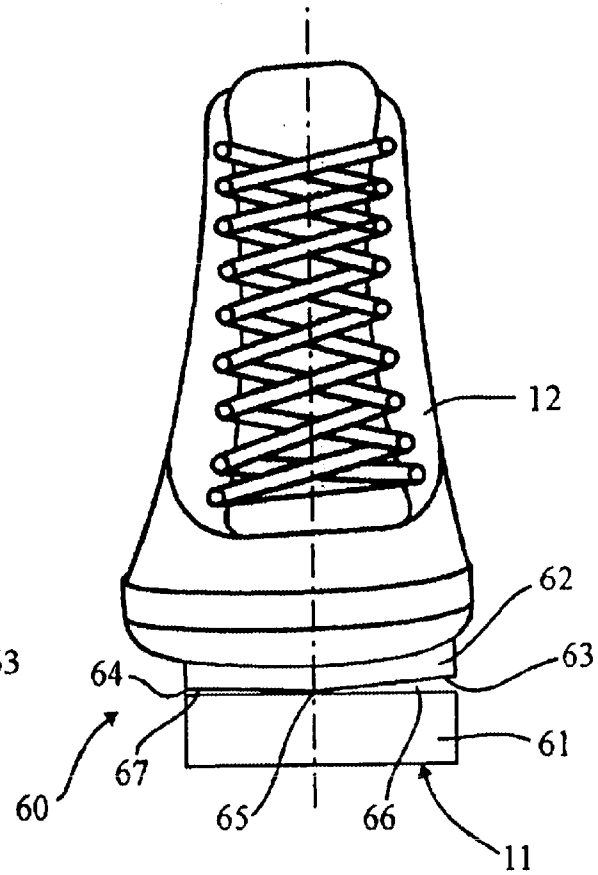
FIGS. 8A, 8B and 8C are front views of parts of shoes or boots, in three different positions.
Figure 8B:
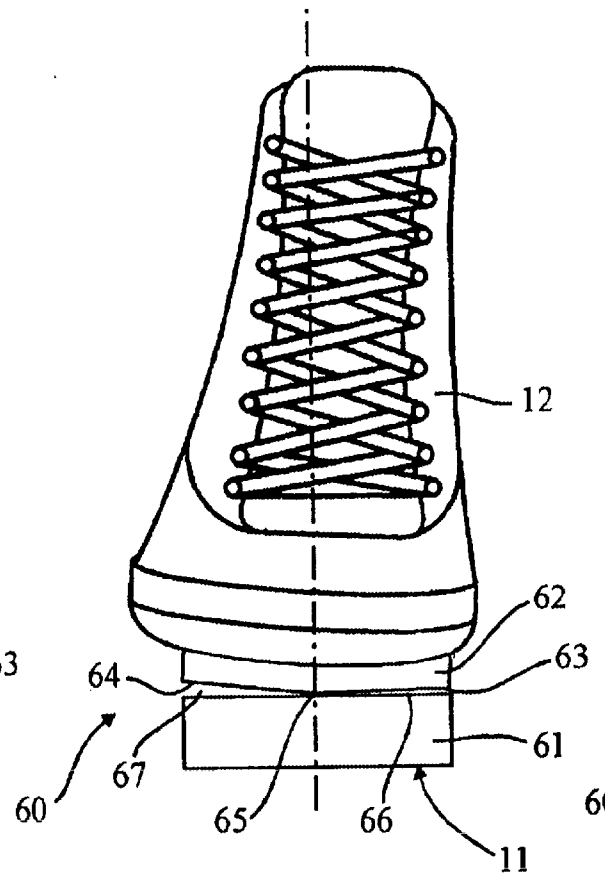
Figure 8A:
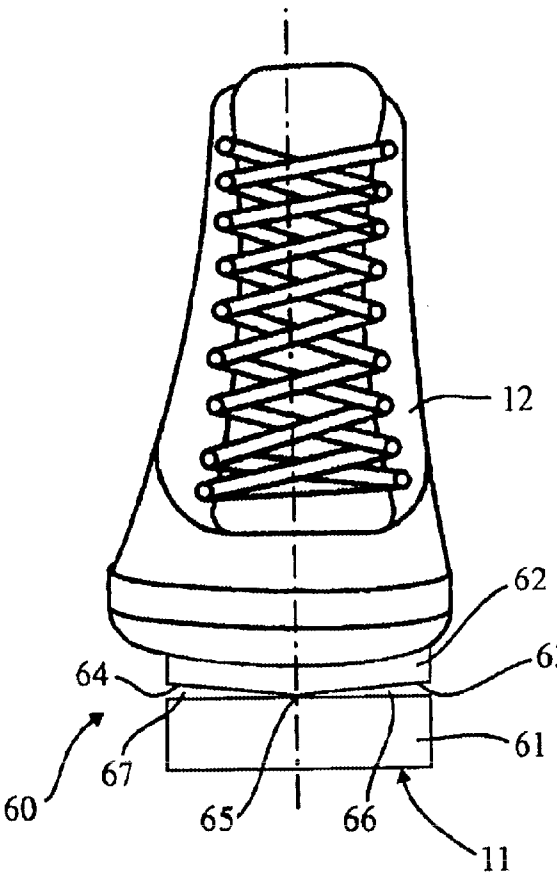

With reference to FIGS. 8A, 8B and 8C, and as mentioned previously, when bending the knee and ankle, the foot is placed naturally in an eversion or valgus position. In this position, the sole of the foot is not placed flat but slightly inclined towards the outside. Inversely, when extending the knee the foot is in inversion position or varus with the foot inclined towards the inside.

In order to allow this movement, the inner boot and/or the frame comprise means to allow a movement around the center line of the foot and the inner boot in relation to the frame, these means being formed by a device 60 for placing the foot valgus/varus. In the embodiment shown in FIGS. 8A, 8B and 8C, the frame 11 comprises a more or less flat sole 61. The inner boot 12 has on the other hand a sole 62 which is slightly domed. It in fact comprises two sloping surfaces 63, 64 arranged either side of a protuberance 65 following the center line of the foot. The protuberance and the two sloping surfaces define two gaps 66, 67 between the sole of the frame and that of the inner boot. These gaps can be filled or not with an easily deformable foam. The longitudinal protuberance 65 acts as hinge and permits tilting movements around a center line. It can be made up of a torsion bar, a deformable strip, one or several elastic elements such as Silentblocs® or any other flexible link system.

In the position illustrated in FIG. 8A, the gaps 66, 67 under each of the sloping surfaces are more or less the same. This foot position corresponds to a neutral position of the skier. In FIG. 8B, the internal section of the foam is crushed. The foot is facing inwards. The inner boot lies on the sloping surface 63 arranged towards the plane of symmetry of the skier. Lastly, in FIG. 8C the external section of the foam is crushed. The foot is facing outwards. The inner boot lies on the sloping surface 64 arranged towards the opposite side of the skier's plane of symmetry.

Figure 9:
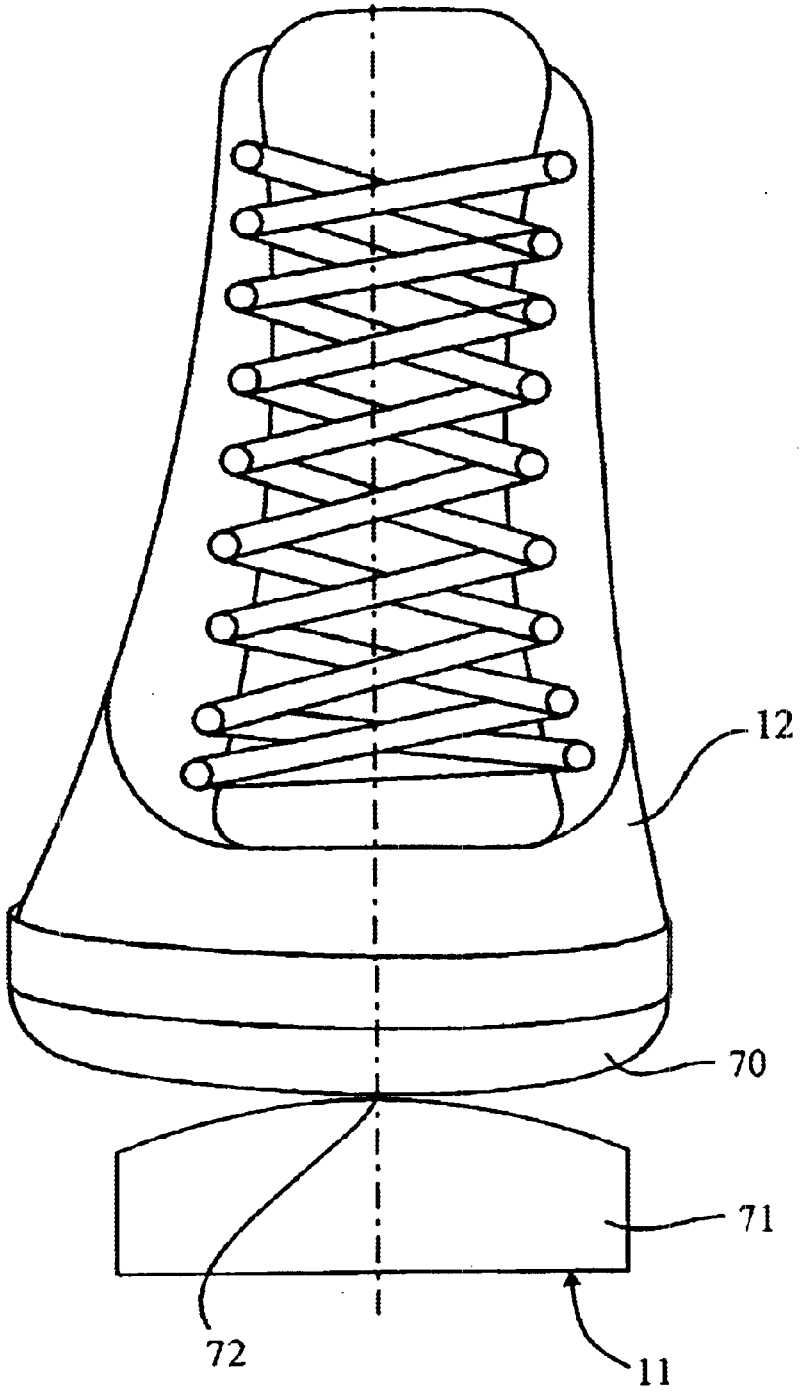
FIGS. 9 and 10 also illustrate two variants which allow movement of the inner boot in the frame of the shoe or boot.

In the embodiment illustrated in FIG. 9, the sole 70 of the inner boot 12 is flat, whilst the sole 71 of the frame 11 is slightly domed and comprises a longitudinal protuberance 72. The working of this embodiment is identical to the embodiment illustrated in FIGS. 8A to 8C. However, in the case of a detachable inner boot, the fact that the sole of the inner boot is flat is an advantage.

By choosing the "stiffness" of the foam placed in the gaps outlined between the soles of the frame and the inner boot either side of the longitudinal protuberance 65, 72, it is possible to adjust the force needed to place the foot inwards or outwards. It is also possible to allow only the varus or valgus position, to the exclusion of the other position. In the same way, the angle of inwards/outwards position can be adjusted by the shape of the protuberance or one of the soles.

Figure 10:
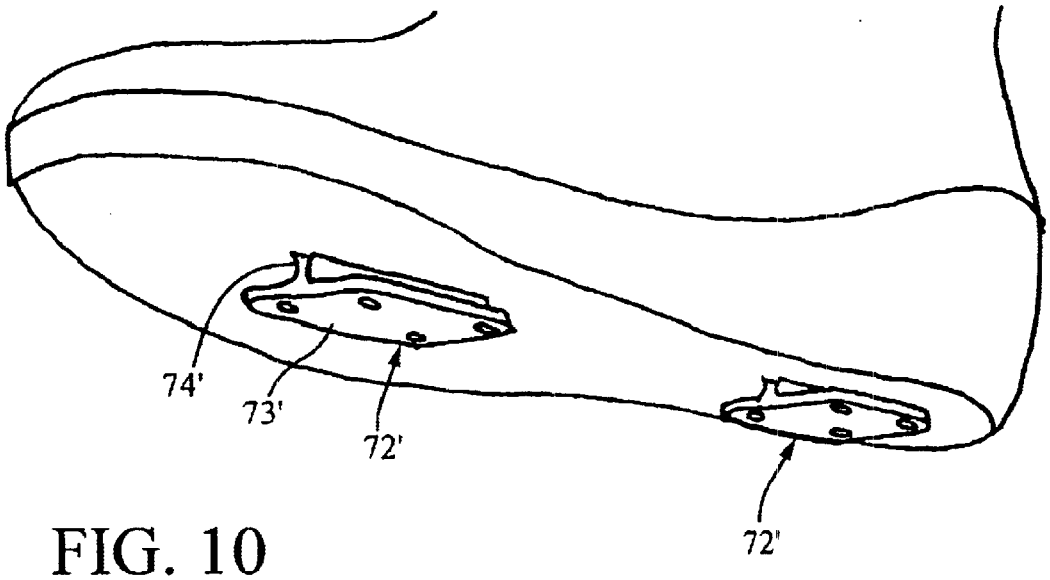
Figure 11:
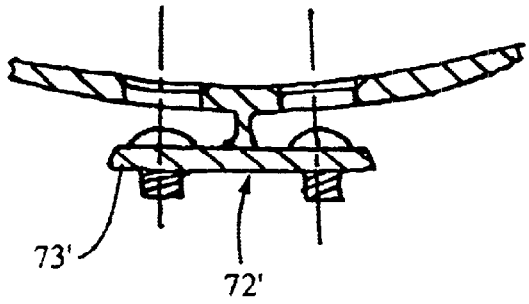
FIG. 11 is a cross-section view of part of the shoe or boot in FIG. 10.

FIGS. 10 and 11 illustrate another form of realization of a shoe or boot according to the invention, which allows the inwards/outwards movement of the foot. The sole of the inner boot comprises two longitudinal protuberances 72' formed by a platform 73' attached to the inner boot by a semi-rigid rib 74' which allows the inner boot to slightly pivot in relation to the center line of the sole. The platforms 73' can for example be screwed in the frame. As before, a filling foam can be arranged under the sole in order to facilitate a sound bond between the boot and the ski, and sound control of the skis, without wasted or fluttering time.

In this type of construction, the foot and leg keep their extensive freedom in natural movements, in bending and rotation without there being play between the leg and the casings.

Figure 12:
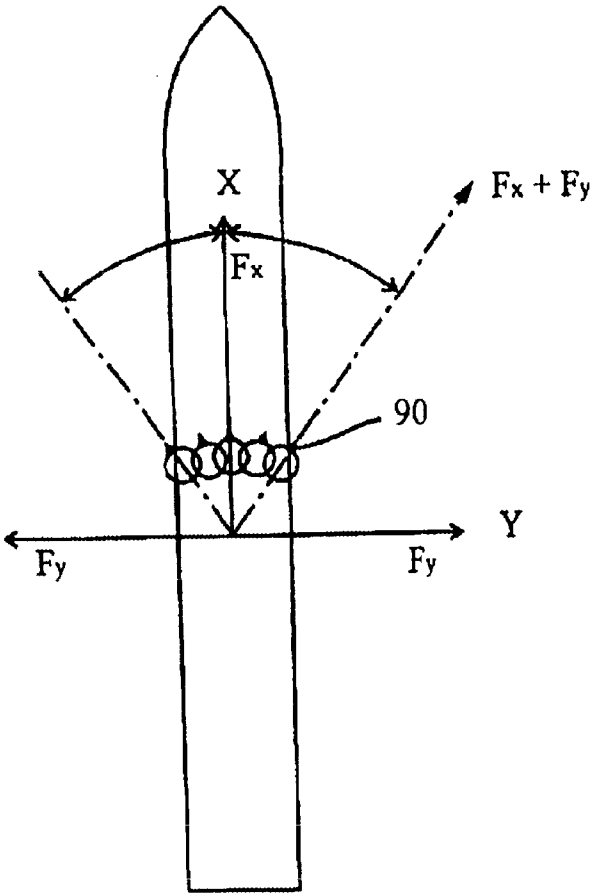
FIG. 12 illustrates the position of the boot during a turn when skiing.

FIG. 12 illustrates the displacement of the tibia during a turn with a boot according to the present invention as well as distribution of efforts during this turn.

When the skier for example wishes to turn right, he bends his leg forwards at the same time as turning the tibia to the right. The axis of the tibia is illustrated by an arrow 90 facing the direction that the skier is trying to achieve. This rotational movement of the tibia is possible due to the means which allow a movement around the center line of the foot. These movements generate a force $F_x$ towards the front of the ski and a force $F_y$ on the side of the ski towards the inside of the turn. The result of these two forces is channelled in the direction that the skier wishes to go. He thus creates a front diagonal bearing force which makes turning easier.

In shoes or boots of the prior art, the force $F_x$ directed forwards is always present. On the other hand, the lateral force is obtained by a leg movement to the side which facilitates obtaining pressure on the edge of the ski. As movements of the lower leg are not possible with shoes or boots of the prior art, this leg movement to the side is made when off balance.

Figure 13:
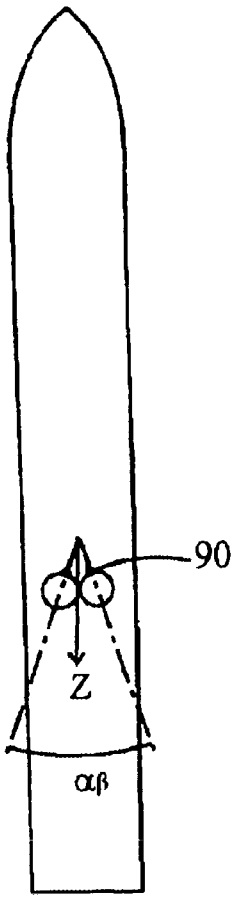
FIG. 13 illustrates the distribution of forces on a ski when using a boot according to the present invention.

FIG. 13 illustrates distribution of the backwards unbalance of the skier. The link extension allows a slight backwards unbalance while still generating forwards pressure which helps the skier to regain a correct position. The axis 90 of the tibia can also pivot at an angle which depends on the position of the skier. In all cases, the position of the whole leg and in particular the foot and the bottom of the leg is a natural position, which allows the use of all the muscles. This makes recovery easier and in most cases avoids rupture of ligaments and bones when falling and twisting backwards.

Figure 14:
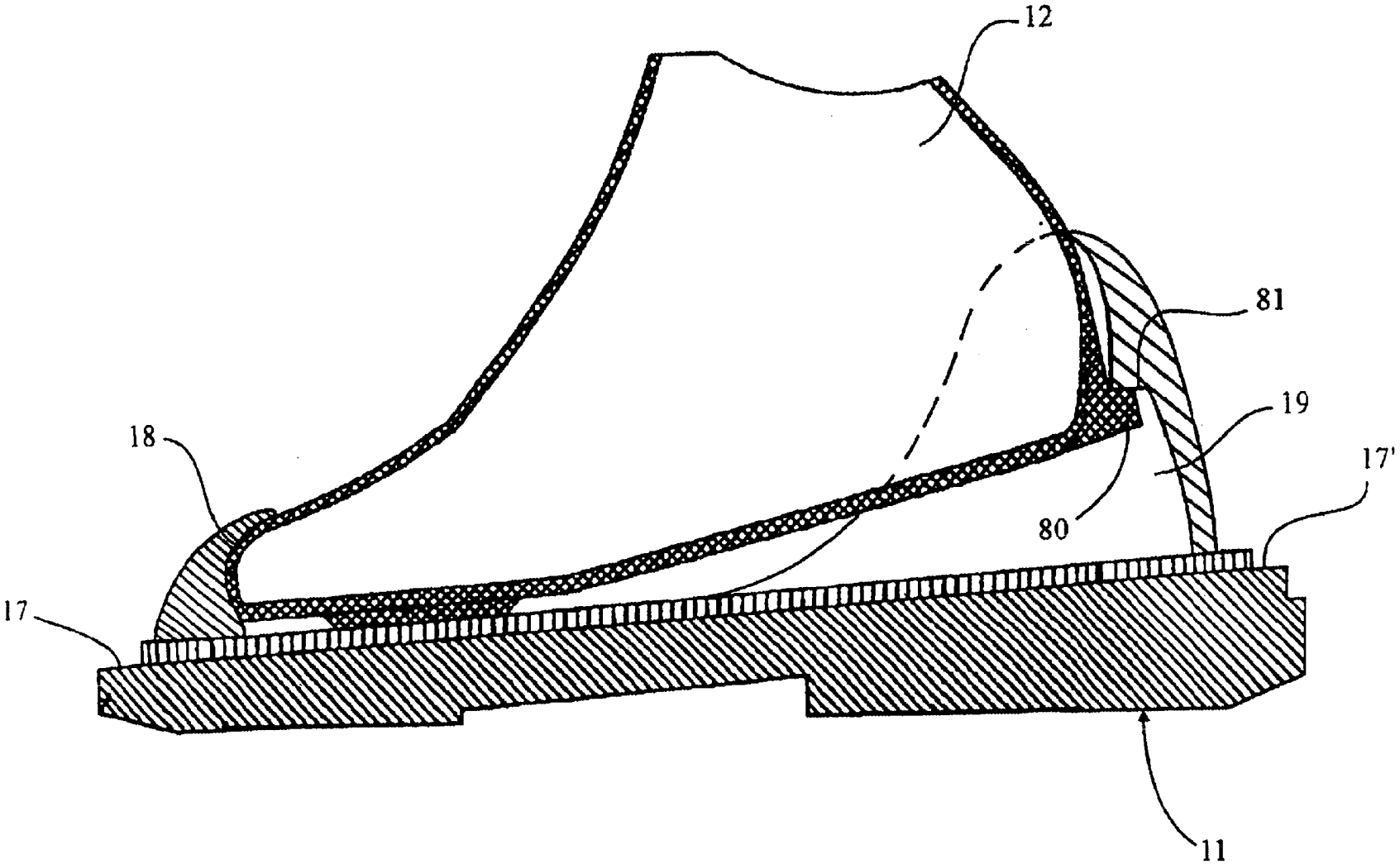
FIG. 14 is a profile section view of part of the shoe or boot according to the invention.

FIG. 14 is a cross-section view of a frame 11 and a inner boot 12 in this frame. The inner boot comprises a shoulder 80 at the back. The frame comprises a buffer stop 81 in concert with the shoulder 80 of the inner boot, so as to allow the vertical movement of the back of the inner boot over a predefined distance, considerably exaggerated in the figure, without it being entirely free. This holding force with margin for play enables the foot to carry out a natural movement of extension, as has been described above. The shoulder 80 or the buffer stop 81 can moreover have a slightly curved shape so as to allow a slight angular rotation of the foot in relation to the center line.

Figure 15:
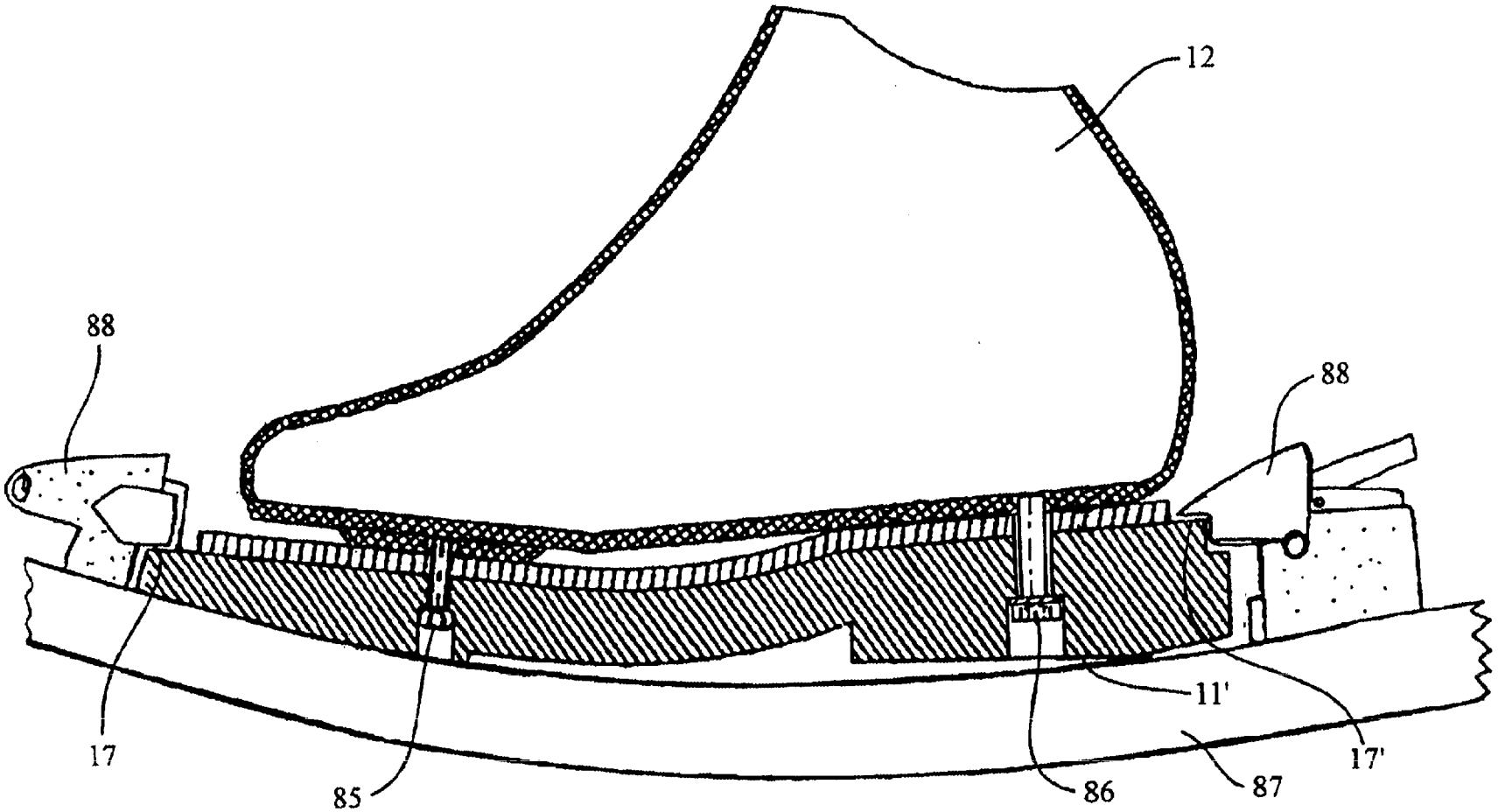
FIG. 15 is a similar view to FIG. 14, of another embodiment of the shoe or boot.

FIG. 15 illustrates an embodiment in which the inner boot 12 is fixed to the frame 11', using for example two screws 85, 86. The frame is not completely rigid which allows the frame and the inner boot to "follow" the deformation of the ski 87.

This avoids deformation of the ski exerting force on the bindings 88, as when using conventional rigid ski boots, which can cause the binding to unfasten even without falling. The head of the rear screw 86 may have a certain amount of play as compared to the housing in which it is placed, which also allows inwards/outwards movement of the foot.

Figure 16:
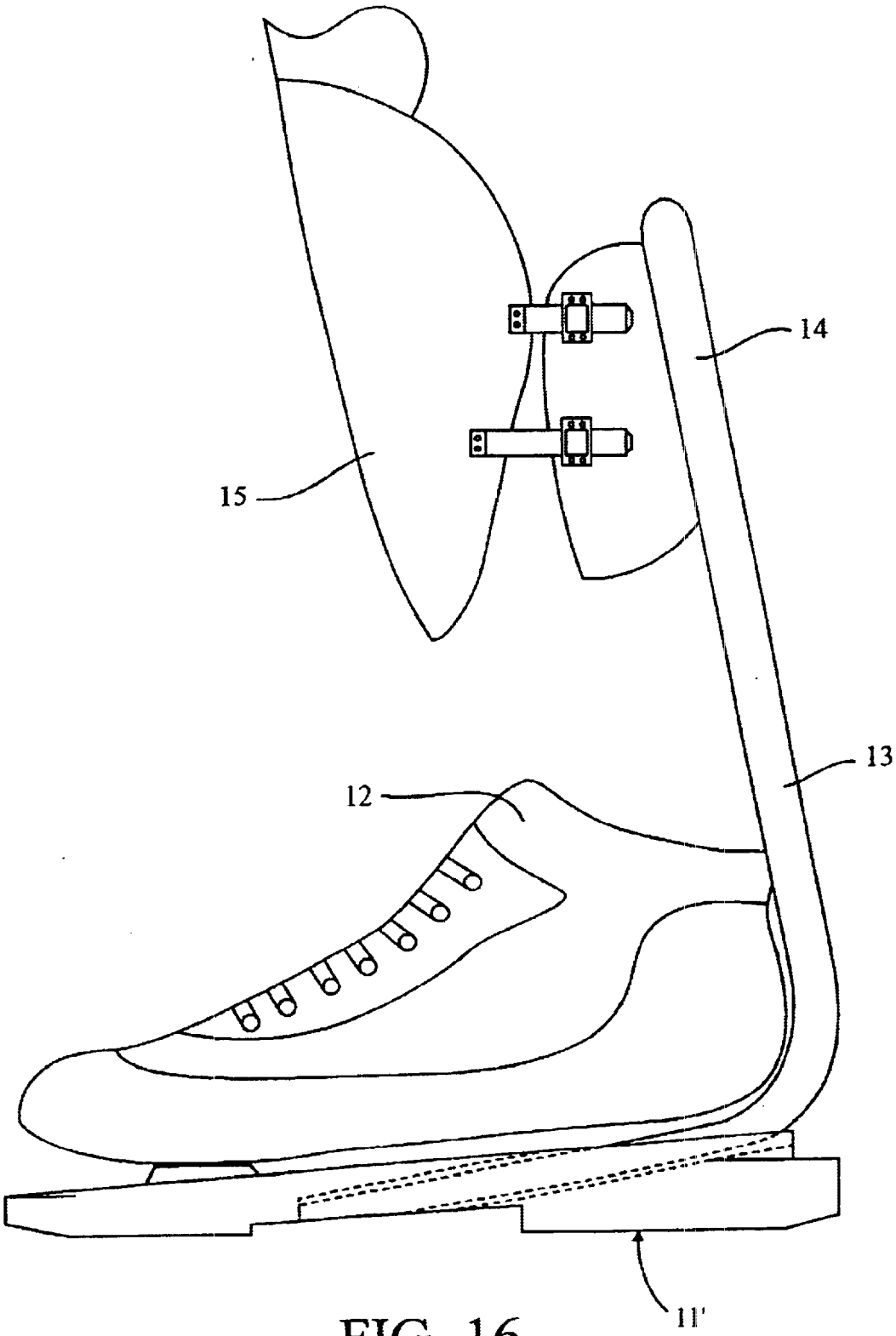
FIG. 16 is a cross-section view of a variant of shoe or boot according to the invention.

FIG. 16 illustrates a variant of the shoe or boot according to the invention, similar to the shoe in FIG. 1. In this variant, the link extension 13 represented as a spring plate is inserted in the frame 11'. It is placed under the sole of the inner boot 12 and enters the frame. The elasticity of the link extension 13 as well as its positioning in relation to the frame and its method of fixing in this frame allow the heel to make a vertical movement which follows any deformation of the extension. This allows, as previously, a natural movement of the wearer's leg. This method of realization is advantageous due to the fact that the shift of both the heel and the link extension, and consequently the casings are all linked. The casings therefore always remain in the appropriate position, whatever the heel movement.

According to a variant, the heel of the inner boot 12 is attached to the frame 11' and does not follow the movements of the link extension 13. In this case, a space must be kept between the inner boot and the extension fixed in the frame. In both cases, movement around the center line of the foot is preserved.

Figure 18:
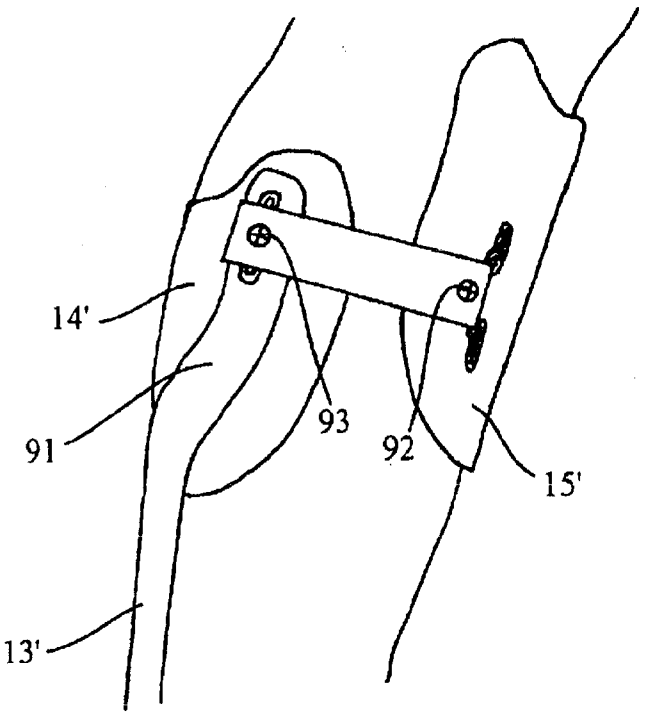
FIG. 18 represents part of a shoe or boot comprising the element in FIG. 17.
Figure 17:
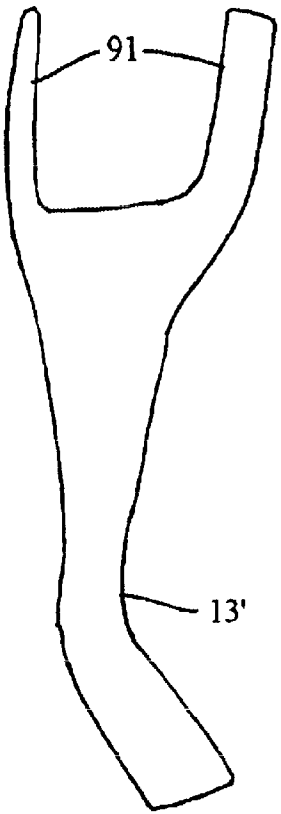
FIG. 17 illustrates a particular embodiment of an element of a shoe or boot according to the invention.
Figure 19:
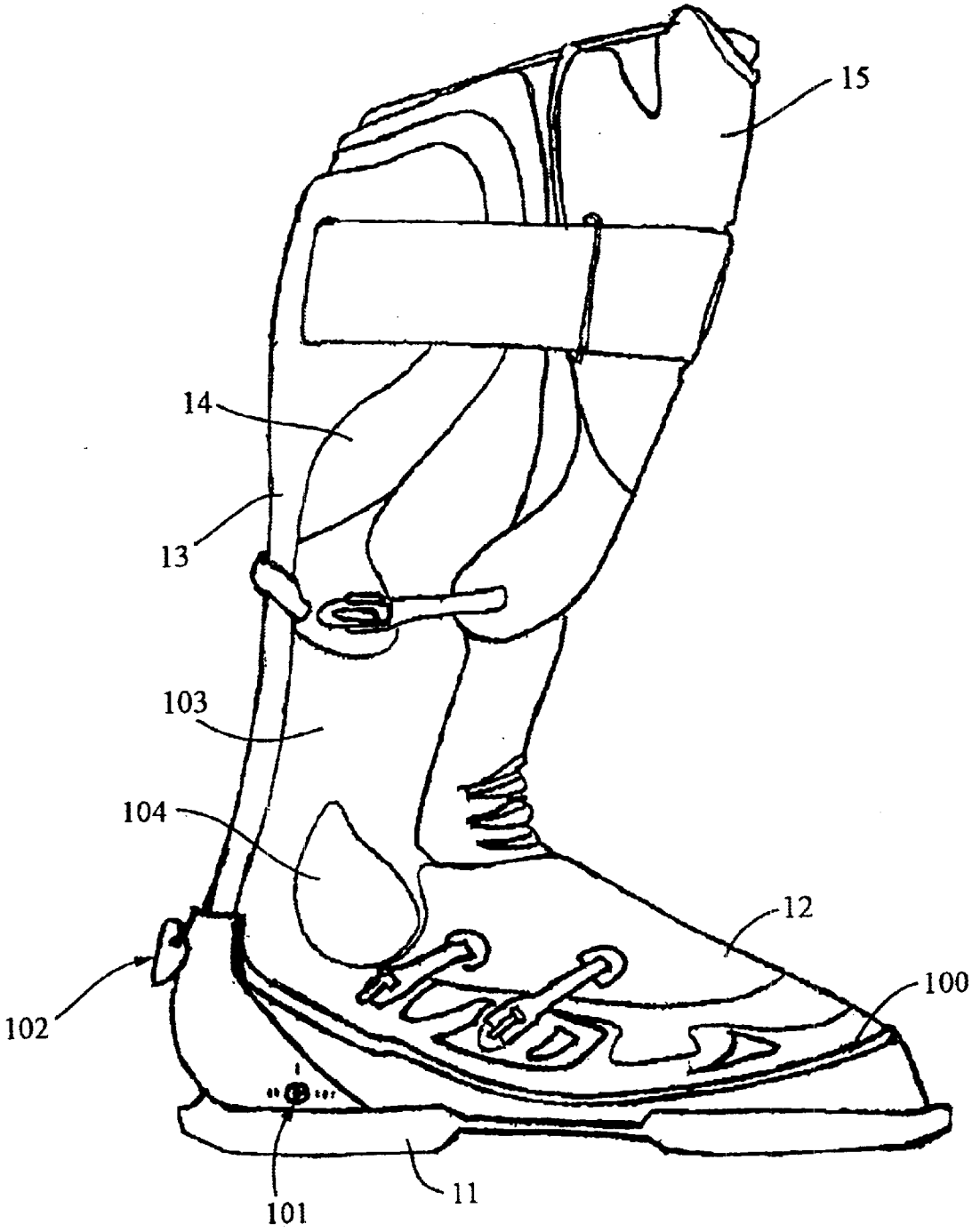
FIG. 19 illustrates a particular form of realization of a shoe or boot according to the invention.

FIGS. 17 and 18 illustrate a particular method of realization for a link extension 13' according to the invention. This link extension divides into two branches 91 in its upper third section. This extension helps to resolve problems associated with shoes or boots comprising one link extension such as mentioned in the prior art. When it is bent to the maximum, the thigh touches the muscles of the calf (triceps). If an element, represented as a rear lever, extends above the lower third of the calf, there is a risk of conflict of the element between the triceps and the ischium leg muscles of the thigh at the time of maximum bending. This type of flexion is frequent with skiers off balance, backwards such as beginners and skiers frightened by the slope. Competition skiers are also liable to this type of unbalance or recovery position.

The present configuration of the link extension 13' follows the principle of having a fulcrum above the middle section of the tibia. The link extensions terminate by two lateral end pieces 91 on which the back casing 14' is attached. This casing can be mobile or incorporated in the construction of the boot.

The front casing 15', is fixed directly to the external branches of the link extension, or free and fixed to the link extensions by means of a strap or collar. To avoid the effects of parallelogram which can hinder support of the leg during bending, the two casings or the support collar of the leg are attached together on two axes 92, 93, arranged on the upper lateral sections of the link extension. They improve mobility of the leg and casings in flexion without affecting its posture.

FIG. 19 represents a boot which can have, through its looks, proportions and size something in common with a motocross boot whose particularity is to incorporate the functions described in the invention, i.e.:

- a rigid frame 11
- one or several link extensions 13
- a set of support casings 14, 15 adjustable in height and volume
- a connection of the inner boot 12 on the frame which allows controlled inward/outward movements of the foot
- mobility in rotation of the casings as a whole in proportion to the natural rotation of the leg.

The inner boot 12 is assembled in the frame 11 so as to be able pivot around the center line of the foot. For this purpose, a gap 100 is left between the upper edge of the frame and the inner boot. In order to ensure leaktightness of the whole unit, this space can be filled with an easily deformable foam or covered with a strip of leaktight material.

This shoe or boot comprises furthermore means 101 to adjust the initial position of the link extension 13. The positioning of the link extension facilitates adapting to the volume of the user's calf, in such a way that whatever the size of the calf, the leg is in a comfortable position. The angle formed by the extension in relation to a vertical line can for example be 10°, 13° and 16° in three possible positions of the adjustment means. These adjustment means 101 can for example comprise an eccentric. The shoe or boot can also comprise a device 102 for freeing the extension to facilitate walking. This device allows a certain amount of play to the bottom of the link extension 13. It is for example also made up of an eccentric which can be placed in two positions as shown in FIG. 19.

Lastly, this shoe or boot can comprise a high prop 103 and incorporate protective components against water and cold. It is essential that this prop be supple so as not to hinder leg movements. It can include extra thickness 104 protecting the user from impacts and cuts. The shoe or boot can incorporate these different components so as to form a homogeneous ensemble looking like a high boot.

Figure 20:
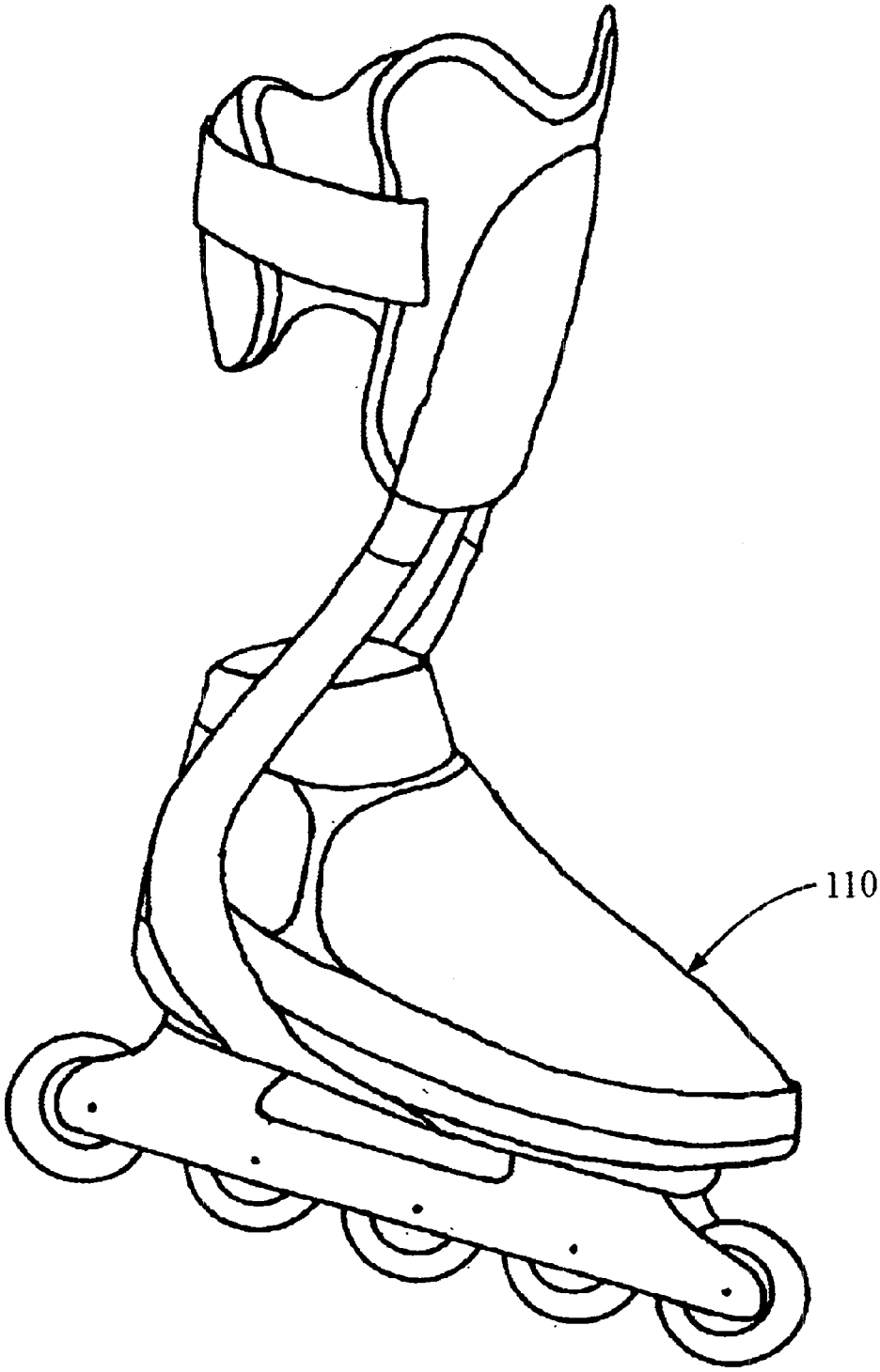
FIG. 20 illustrates a roller skate according to the invention.

Lastly, FIG. 20 represents an application of the shoe or boot according to the invention made in the shape of a roller skate boot 110. As in the preceding examples, this boot allows making movements which are entirely in line with physiological movements.

The boot can be fixed or simply placed on the frame, without rigid interconnection. In this case, the leg and the ski are only held by the link extensions. This realization offers two considerable advantages. The skier can use practically any inner boot that fits in the frame. He can therefore choose inner boots in which he is particularly comfortable. On the other hand the foot is not blocked in rotation. This allows the foot to rotate around the vertical axis (Y) which is naturally related to rotation of the knee.

So as to adopt a natural position, the inside edges of the two feet are not strictly parallel when the skis are parallel. On the contrary they are slightly spread open so as to form an angle of several degrees towards the exterior. The reason for this angle is to encourage the roll movement of the heel bone on the ankle bone which facilitates the inwards/outwards positioning of the rear zone of the foot and consequently the natural pronation-supination movement.

This boot gives a perfect link between the leg and the ski. This link is made without compression, over a relatively large surface. It does not therefore cause pain as in the case of rigid boots. On the other hand, this link permits all the natural movements of the leg and the foot. This has the advantage of limiting risks of injury, increasing the comfort of the skier and considerably improving his or her sensitivity. The boot forms a "self-supporting exoskeleton" which in no way hinders the user's movements. Movements of the user are entirely transmitted from the internal skeleton of the user to this "exoskeleton" which is linked to the ski so as to direct it.

The elasticity of the ski, the link extensions and possibly the frame provide total freedom for the flexion of the ankle. In this way, with the boot according to the invention, deformation of the ski on an obstacle, combined with the flexion of the link extensions, no longer causes hard areas on the tibia, therefore unbalance generally linked to the effect of bearing points, and results in absorbing the bump by providing maximum comfort. With conventional hard boots, when the ski comes up against an obstacle, it is deformed and the energy is sent back to the user's leg. The latter, due to the abrupt slowing down and acceleration of the body forwards, then the backwards compensation, is often thrown off balance backwards. The boot according to the invention has a function of shock absorber.

Such a boot, due to the dynamic pliable effect of the link extension, helps the leg to tolerate considerable twisting force at the time of falling. Especially when falling backwards, spring action, suppleness in bending and the controlled tolerance in rotation, give the leg a better chance of resisting damage and ligament rupture, notably rupture of the knee ligaments which occur in more than a third of ski accidents.

Resistance time of the maximum effort of the leg is prolonged and avoids the effects of shearing due to violent and abrupt effort which is what happens in the boots of the prior art.

The presence of freedom when bending backwards facilitates using the ischium-leg muscular system and the muscular chambers of the leg and foot, as this muscular system is capable of protecting the passive ligament structures at the time of off-balance or falling.

Another recognised ski injury factor is the accident in twisting and/or frontal deviation. The reasoning involving the extension flexion (movement in the sagittal plane) and control depending on the type of boot is also valid in the frontal plane (varus valgus).

In the horizontal plane the fact of liberating the inversion eversion movement of the foot allows rotation of the tibia on the fixed foot while this is not at all the case in boots of the prior art. The least strain in rotation of the femur or thigh bone in relation to the ski boot system must be absorbed by the knee or the bindings.

If the knee is bent more than 45 degrees, its freedom of rotation is between 30 and 40 degrees and the rotatory component of the ischium-leg muscles is at its maximum. On the other hand, the more one draws nearer the extension, the more the degree of freedom in knee rotation decreases to become nil in complete extension. The rotatory component of the ischium-leg muscles also decreases and therefore their ability to prevent twisting of the femur on the tibia. Only the bone and ligament structures can provide this role hence the frequency of damage to the anterior cruciate ligaments, tibial-peroneal ligaments or spiral fracture of the tibia.

With the boots according to the present invention, the freedom of rotation of the ski/boot relation under the knee is greater than with boots of the prior art, and this movement is controlled by muscles of the leg and foot (peroneal and leg muscles). This factor is a considerable protection factor for passive structures such as ligaments and bones of the lower member.

As the boot is made up of different independent elements, each of these elements can be adapted to the morphology of the skier as well as to his capacity. It is therefore possible to choose each of the elements amongst a series of standard elements so as to fashion a 'tailor-made' boot.

The use of the link extension makes the boot dynamic. The extension or extensions can store energy and impart this energy at the time of flexion and extension movements by the skier.

The shape of the link extensions also allows storing energy during twisting movements. When bending the knee, the lower part of the leg sustains a twisting movement which is transmitted to the link extensions. This facilitates storing energy which is transferred back when turning for example which makes directing the skis easier. The casings guarantee that the twisting movements of the leg are entirely transmitted to the boot, failing which the skis would be difficult to direct and the ankle would probably have to compensate for the efforts not transmitted.

The boot according to the present invention is especially comfortable, it gives optimum control of the skis and it considerably limits the risks of breaking of bones in the lower section of the leg. Furthermore, the user retains excellent feeling which helps to keep balance. This also helps when learning to ski.

The combined function of turning the foot outwards on the frame and rotation of the casings cause a diagonal bearing effect. This combined pressure of force forwards and on the side is sought-after by all skiers, but with boots of the prior art the effort is broken down into two distinct movements—one forwards so as to create a load on the front of the ski when going into a turn and a leg movement on the side to obtain pressure on the edge of the ski and thus grip the snow.

With the present invention, at the moment of flexion by the skier, the inwards or outwards movement of the foot is combined with the natural leg rotation. The result is forward diagonal bearing pressure towards the direction that the skier wishes to take. In practice therefore turning is instantaneous and control in the curve is more accurate. The skier is ahead in his body language and no longer needs to concentrate both on the forward pressure and at the same time the lateral pressure bearing.

Such a boot is a considerable asset when learning to ski. The pivoting efforts of the ski are made easier thanks to the lever effect and the precise physiological movements of the articulations and muscles of the foot, ankle and leg. In this way, modern skis with marked indentations provide, with this boot, a genuine "steering wheel" or "assisted steering" to direct them.

The storing of the energy supplied by the skier during stress is transferred back in proportion to the effort by the skier. With tight turns requiring good dynamics, the work of the material means a saving of effort. For wide turns requiring more progressive transfer of bearing dynamics with no time wasted, the boot also transfers the energy back proportionately.

The shoe has mainly been described in an application as a ski boot. The same shoe could also be used for other sports and for example as a boot for roller skates or ice skates notably. It can also be used for ski touring, cross-country skiing or surfboarding depending on the various construction methods.

Various methods of realization of support casings allow transferring the force directly from the leg to the ski through the link extension—these different methods of realization are adjustable both for leg volume as well as rotational mobility through their link with the extension.

What is claimed is:

1. A sports shoe or boot, notably for alpine skiing, ski touring, cross-country skiing, surfboarding, roller skating or ice skating, comprising a rigid frame (11, 11') arranged under the ankle of a wearer of said sports shoe and defining at least a housing (18*a*, 18*b*) in which is placed an inner boot (12) receiving the wearer's foot and cooperating with said frame (11, 11'), at least a link extension (13, 13' 27, 30, 31, 40, 41, 50, 51) between the frame and the leg of the wearer, said link extension being resilient in flexion and in rotation, and at least one casing (14, 14', 15) fitted to join the wearer's leg firmly to the link extension, wherein the sports shoe (11, 11') further comprises at least a longitudinal protuberance (65, 72, 72') arranged between the inner boot (12) and the frame (11, 11') under said inner boot (12) and designed to allow movement of the inner boot (12) in relation to the frame (11, 11') around the longitudinal axis of the foot during use of the sport shoe by the wearer.

2. The sports shoe or boot according to claim 1, wherein the longitudinal protuberance (65) is attached to the inner boot (12).

3. The sports shoe or boot according to claim 1, wherein the longitudinal protuberance (72) is attached to the frame (11, 11').

4. The sports shoe or boot according to claim 1, wherein the longitudinal protuberance comprises two longitudinal protuberances (72') formed by a platform (73') attached to the shoe by a flat semi-rigid reinforcing rib (74') in line with the longitudinal axis of the foot.

5. The sports shoe or boot according to claim 1, wherein the longitudinal protuberance (65, 72, 72') arranged between the inner boot (12) and the frame (11, 11') defines gaps (66, 67) on either side of this protuberance, these gaps being filled with a soft material.

6. The sports shoe or boot according to claim 1, wherein the frame (11, 11') comprises a way to allow a vertical movement of the heel of the inner boot (12) in relation to the frame.

7. The sports shoe or boot according to claim 6, wherein the way to allow a vertical movement of the heel of the inner boot (12) comprise a shoulder (80) arranged on the shoe and a buffer stop (81) shaped in the frame (11).

8. The sports shoe or boot or bot according to claim 1, wherein said shoe comprises a back casing (14, 14', 44) fitted to be adapted to the morphology of the wearer's calf, and a front casing (15, 43) fitted to be adapted to the morphology of the wearer's tibial plate, at least one of the casings being attached to the link extension (13, 13', 27, 30, 31, 40, 41, 50, 51).

9. The sports shoe or boot according claim 8, wherein the front casing (15) comprises a knee bearing element (23), fitted to be in contact with the wearer's knee.

10. The sports shoe or boot according to claim 8, wherein the casing (14, 14',15) fixed to the link extension is mobile in rotation over a given angular range, around the link extension.

11. The sports shoe or boot according to claim 8, wherein said shoe comprises means for adjustment of the volume in between the back and front casings.

12. The sports shoe or boot according to claim 8, wherein said shoe comprises means (33) for adjustment of the height of the front casing (15) and/or black casing (14).

13. The sports shoe or boot according to claim 1, wherein the link extension (13, 31) has an end piece arranged near the extremity of the peroneal muscles.

14. The sports shoe or boot according to claim 1, wherein the link extension (30) has an end piece arranged near the heel.

15. The sports shoe or boot according to claim 1, wherein said shoe comprises two link extensions (13, 13', 27, 30, 31, 40, 41, 50, 51).

16. The sports shoe or boot according to claim 15, wherein at least one of the link extensions (13, 13', 30, 31) is arranged towards the back of the inner boot (12).

17. The sports shoe or boot according to claim 16, wherein the two link extensions (40, 41, 50, 51) are arranged on the sides of the inner boot (12).

18. The sports shoe or boot according to claim 1, wherein the link extension is arranged between the inner boot (12) and the frame (11).

19. The sports shoe or boot according to claim 1, wherein the link extension (30) is formed by at least two superimposed strips (30*a*, 30*b*).

20. The sports shoe or boot according to claim 1, wherein the inner boot (12) is detachable from the frame (11, 11').

21. The sports shoe or boot according to claim 1, used as a ski boot, wherein, when the wearer is skiing, each inner boot (12) is placed in the frame (11, 11') in such a manner that when the two skis (87) are parallel, the edge of one shoe, arranged towards the plane of symmetry of the wearer's body, forms an angle opening forwards as compared with the corresponding edge of the other shoe.

* * * * *